US008590318B2

(12) United States Patent
Saito et al.

(10) Patent No.: US 8,590,318 B2
(45) Date of Patent: Nov. 26, 2013

(54) PULSE-TUBE REFRIGERATING MACHINE

(75) Inventors: Motokazu Saito, Tokyo (JP); Mingyao Xu, Tokorozawa (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 917 days.

(21) Appl. No.: 12/149,050

(22) Filed: Apr. 25, 2008

(65) Prior Publication Data

US 2008/0264071 A1 Oct. 30, 2008

(30) Foreign Application Priority Data

Apr. 26, 2007 (JP) ..... 2007-117552

(51) Int. Cl.
*F25B 9/00* (2006.01)
*F25B 19/00* (2006.01)
*F25J 1/00* (2006.01)

(52) U.S. Cl.
USPC ..... 62/6; 62/600; 62/51.1

(58) Field of Classification Search
USPC ..... 62/6, 600, 602, 612, 51.5, 55.5, 1.25, 62/51.1
See application file for complete search history.

(56) References Cited

U.S. PATENT DOCUMENTS

| | | | | |
|---|---|---|---|---|
| 5,974,807 | A * | 11/1999 | Gao et al. | 62/6 |
| 6,378,312 | B1 * | 4/2002 | Wang | 62/6 |
| 6,619,046 | B1 * | 9/2003 | Mitchell | 62/6 |
| 7,131,276 | B2 * | 11/2006 | Pan et al. | 62/6 |
| 7,350,363 | B2 * | 4/2008 | Stautner et al. | 62/6 |
| 7,568,351 | B2 * | 8/2009 | Xu et al. | 62/6 |
| 2006/0174635 | A1 * | 8/2006 | Xu et al. | 62/6 |

FOREIGN PATENT DOCUMENTS

| | | | |
|---|---|---|---|
| JP | 08-271069 A | | 10/1996 |
| JP | 08271069 A | * | 10/1996 |
| JP | 09-243189 A | | 9/1997 |
| JP | 09243189 A | * | 9/1997 |
| JP | 2001-263841 A | | 9/2001 |
| JP | 2001263841 A | * | 9/2001 |
| JP | 2005-055047 A | | 3/2005 |
| JP | 2005055047 A | * | 3/2005 |
| JP | 2005-156029 A | | 6/2005 |
| JP | 2005156029 A | * | 6/2005 |

OTHER PUBLICATIONS

JPO Office Action, App. No. 2007-117552, Transmission Date: Aug. 17, 2010 (4 pages).
JPO Office Action, App. No. 2007-117552, Transmission Date: Nov. 25, 2008 (2 pages).

* cited by examiner

*Primary Examiner* — Frantz Jules
*Assistant Examiner* — Keith Raymond
(74) *Attorney, Agent, or Firm* — Rader, Fishman & Grauer PLLC

(57) ABSTRACT

A pulse-tube refrigerating machine includes: a compressor that pressurizes a refrigerant gas; a regenerator tube accommodating a regenerator material therein; a pulse-tube having of a hollow cylinder through which the refrigerant gas flows; an intake valve and an exhaust valve provided between the compressor and the regenerator tube. A heat-shielding material is provided to at least a portion of at least one of a first wall forming a portion of the pulse-tube and a second wall contacting a portion of the pulse-tube.

4 Claims, 5 Drawing Sheets

PULSE-TUBE REFRIGERATING MACHINE

BACKGROUND OF THE INVENTION

1. Field of the Invention

The present invention generally relates to refrigerating machines and, more particularly, to a pulse-tube refrigerating machine.

2. Description of the Related Art

Conventionally, a pulse-tube refrigerating machine is used to cool an apparatus requiring an extremely low-temperature environment, such as, for example, a nuclear magnetic resonance apparatus (MRI).

FIG. 1 shows an outline structure diagram of a two-stage pulse-tube refrigerating machine as an example of a pulse-tube refrigerating machine. The two-stage pulse-tube refrigerating machine 10 comprises a housing part 1 and a cylinder part 2 connected to the housing 1.

The housing part 1 includes a housing 5 that accommodates therein component parts such as a reservoir, an orifice, a valve, piping, etc. A refrigerant gas such as helium gas or the like is supplied from a compressor 3 into the housing part under a high pressure at a predetermined cycle. The refrigerant gas is discharged from the housing part 1 under a low-pressure.

The cylinder part 2 is connected with the housing part 1 through a flange 11. The cylinder part 2 includes a first-stage pulse-tube 12 and a second-stage pulse-tube 13. The pulse-tubes 12 and 13 are fixed at their upper ends (high-temperature ends) to the flange 11. Further, the cylinder part 2 has a first-stage regenerator tube 14 and a second-stage regenerator tube 16. The upper end of the second-stage regenerator tube 16 is connected to a first-stage cooling stage 15, which is connected to the lower ends of the first-stage pulse-tube 12 and the first-stage regenerator tube 14. Additionally, a second-stage cooling stage 17 is connected to the lower ends of the second-stage pulse-tube 13 and the second-stage regenerator tube 16. The upper end of the first-stage regenerator tube 14 is fixed to the flange 11 similar to the first-stage pulse-tube 12 and the second-stage pulse-tube 13. Additionally, the upper end (high-temperature end) and the lower end (low-temperature end) of the first-stage pulse-tube 12 are connected with rectifying members 12A and 12B, respectively. Also, the upper end (high-temperature end) and the lower end (low-temperature end) of the second-stage pulse-tube 13 are connected with rectifying members 13A and 13B, respectively.

If the overall length of the above-mentioned pulse-tube refrigerating machine is long, a handling operation, such as installing the refrigerating machine to an apparatus to be cooled or removing the refrigerating machine from the apparatus to be cooled, becomes difficult. Thus, it is suggested to shorten the overall length of a pulse-tube refrigerating machine by substituting a portion of the upper end (high-temperature end) of the first-stage pulse-tube 12 or the second-stage pulse-tube 13 by a space formed in the housing 5 (refer to Patent Document 1).

Patent Document 1: Japanese Laid-Open Patent Application No. 2005-156029

However, if a space for the pulse-tube is formed in the housing 5, the refrigerant gas flowing through the pulse-tube is brought into contact with a wall of the housing forming the space. The housing part 1 made of aluminum or an aluminum alloy is at a substantially room temperature, while the refrigerant gas is at a relatively low-temperature. Accordingly, a heat transfer tends to occur in the housing wall, thereby generating a heat loss in the refrigerant gas.

Moreover, under such a contact state of the refrigerant gas and the housing wall, the characteristic of the refrigerant gas tends to be influenced by a change in the ambient environmental condition (for example, temperature change). This means that, if the settings for operating the pulse-tube refrigerating machine, such as, for example, a setting of open and close timing of an orifice, is optimized while expecting a certain characteristic of the refrigerant gas, an actual operation of the pulse-tube refrigerating machine is deviated from an optimum state due to a change in an ambient environmental condition.

Therefore, when the space for the pulse-tube is formed in the housing, there is a problem in that a finally-obtained refrigerating capacity of the pulse-tube refrigerating machine is reduced.

Moreover, even in a more conventional pulse-tube refrigerating machine (that is, the structure shown in FIG. 1) having no space for a pulse-tube in a housing, if the thickness of the flange is increased, a heat loss according to a heat transfer through a contact portion of the flange and the pulse-tube becomes not negligible. Therefore, the above-mentioned problem of the reduction in the refrigerating capacity also occurs in such a pulse-tube refrigerating machine.

SUMMARY OF THE INVENTION

It is a general object of the present invention to provide a novel, improved and useful pulse-tube refrigerating machine in which the above-mentioned problems are eliminated.

A more specific object of the present invention is to provide a pulse-tube refrigerating machine in which a heat loss of a refrigerant gas due to a heat transfer between the refrigerant gas and a peripheral member is hardly generated, thereby providing an excellent cooling capacity.

In order to achieve the above-mentioned objects, there is provided according to one aspect of the present invention a pulse-tube refrigerating machine comprising: a compressor that pressurizes a refrigerant gas; a regenerator tube accommodating a regenerator material therein; a pulse-tube of a hollow cylinder through which the refrigerant gas flows; an intake valve and an exhaust valve provided between the compressor and the regenerator tube; at least one of a first wall forming a portion of the pulse-tube and a second wall contacting a portion of the pulse-tube; and a heat-shielding material provided to at least a portion of the at least one of the first and second walls.

The pulse-tube refrigerating machine according to the present invention may further comprise a housing connected with said pulse tube, wherein each of the first and second walls may be a wall of the housing, and the heat-shielding material may be provided to at least a portion of the wall of the housing.

The pulse-tube refrigerating machine may further comprise a flange connecting between the housing and the pulse-tube, wherein the flange may include at least one of a first flange wall forming a portion of the pulse-tube and a second flange wall contacting a portion of the pulse-tube, and the heat-shielding material may be provided to at least a portion of the at least one of the first and second flange walls.

In the pulse-tube refrigerating machine according to the present invention, the heat-shielding material may be a material selected from a group consisting of polytetrafluoroethylene, a glass fiber reinforced plastid (GFRP), a silicon carbide base fiber reinforced plastic (SiC-FRP), a polyethylene foam, a polystyrene foam and a polypropylene foam (EPP).

Additionally, there is provided according to another aspect of the present invention a pulse-tube refrigerating machine having a pulse-tube connected to a housing through a flange, wherein the flange includes at least one of a first flange wall forming a portion of the pulse-tube and a second flange wall contacting a portion of the pulse-tube, and a heat-shielding material is provided to at least a portion of the at least one of the first and second flange walls.

In the above-mentioned pulse-tube refrigerating machine, the heat-shielding material may be a material selected from a group consisting of polytetrafluoroethylene, a glass fiber reinforced plastic (GFRP), a silicon carbide base fiber reinforced plastic (SiC-FRP), a polyethylene foam, a polystyrene foam and a polypropylene foam (EPP).

Other objects, features and advantages of the present invention will become more apparent from the following detailed description when read in conjunction with the accompanying drawings.

DETAILED DESCRIPTION OF THE PREFERRED EMBODIMENT

A description will now be given, with reference to FIG. 2, of a pulse-tube refrigerating machine according to an embodiment of the present invention.

Figure 1:
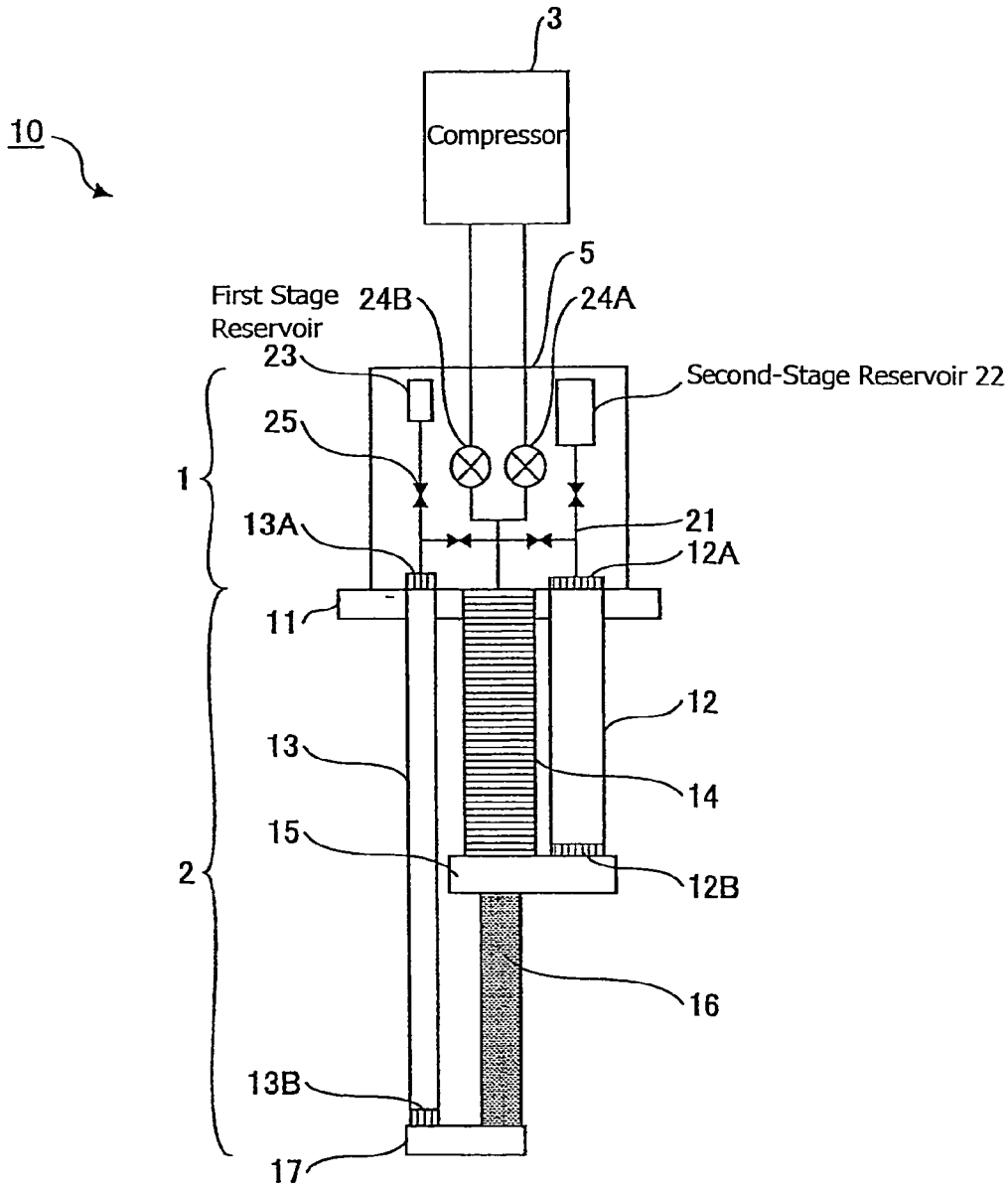
FIG.1 (PRIOR ART)
FIG. 1 is an illustration of an example of a two-stage pulse-tube refrigerating machine.
Figure 2:
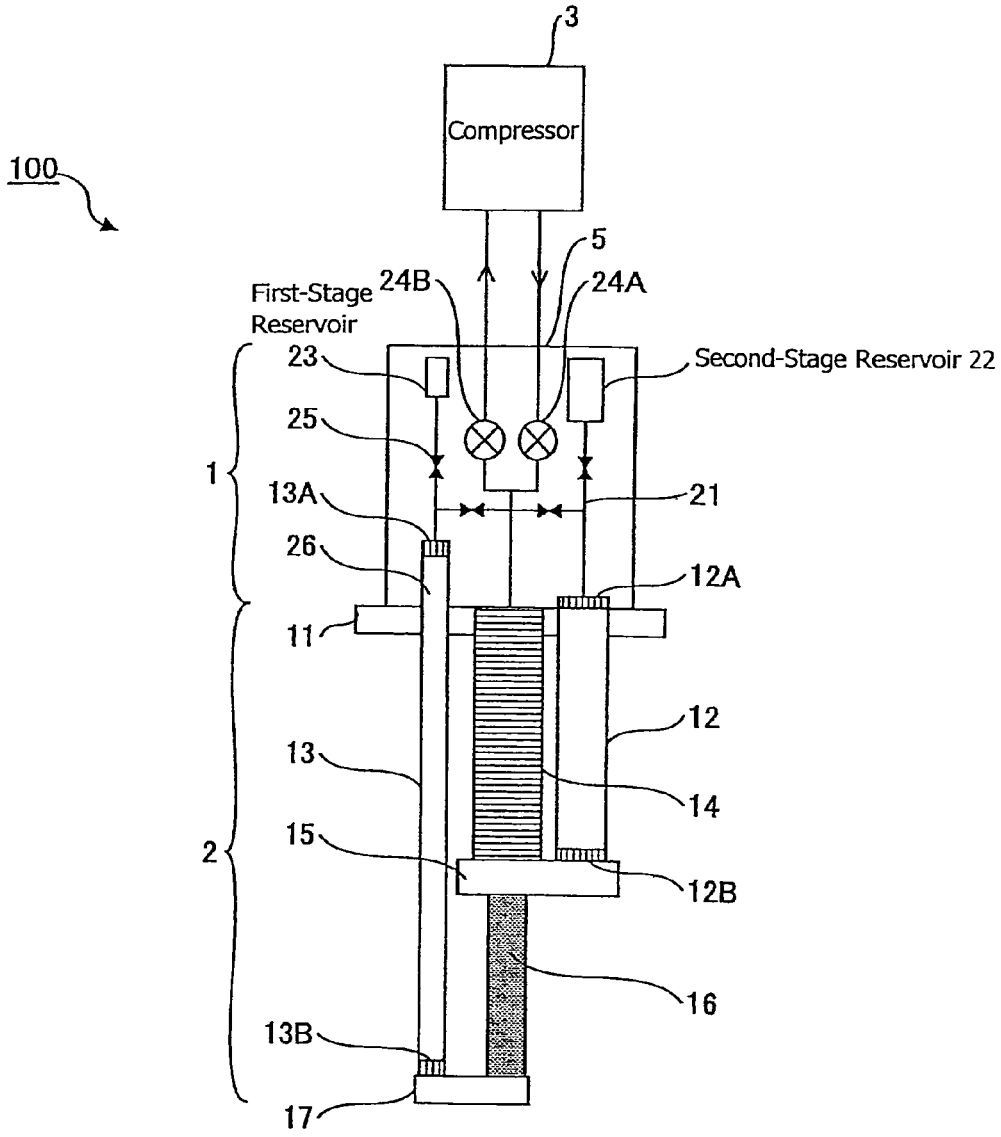
FIG.2 (PRIOR ART)
FIG. 2 is an illustration of a two-stage pulse-tube refrigerating machine according to an embodiment of the present invention.

FIG. 2 shows an outline structure of the pulse-tube refrigerating machine according to the embodiment of the present invention. It should be noted that although a two-stage pulse-tube refrigerating machine is shown in FIG. 2, the present invention is not limited to the two-stage pulse-tube refrigerating machine and is applicable to other pulse-tube refrigerating machines. In FIG. 2, parts that are the same as the parts shown in FIG. 1 are given the same reference numerals, and descriptions thereof will be omitted.

The pulse-tube refrigerating machine 100 shown in FIG. 2 comprises the housing part 1 and the cylinder part 2 connected to the housing part 1 through the flange 11.

The housing part 1 includes the housing 5. The housing 5 has a first-stage reservoir 22 and a second-stage reservoir 23 incorporated therein. The first-stage reservoir 22 and the second-stage reservoir 23 are connected to the first-stage pulse-tube 12 and the second-stage pulse-tube 13, respectively, through a gas pipe 21. The housing 5 accommodates an intake valve 24A and an exhaust valve 24B, which are provided to gas pipes connected to the compressor 3. Further, the housing accommodates orifices 25 provided at four positions along the gas pipe 21. The orifices 25 are provided for adjusting a phase difference between periodically changing pressure and volumetric flow of the refrigerant gas in the first-stage pulse-tube 12 and the second-stage pulse-tube 13 so as to appropriately generate cold and warm at the low-temperature ends of the first-stage pulse-tube 12 and the second-stage pulse-tube 13. The housing 5 is preferably made of aluminum or an aluminum alloy.

A basic structure of the cylinder 2 is the same as the cylinder part shown in FIG. 1, and a description thereof will be omitted. The first-stage regenerator tube 14 includes a hollow cylinder made of, for example, a stainless steel and a regenerator material accommodated in the cylinder. The regenerator material is preferably a wire netting of capper or a stainless steel. The first-stage pulse-tube 12 is preferably a hollow cylinder made of a stainless steel. The first-stage cooling stage 15 has a gas passage formed therein so that the low-temperature end (lower end) of the first-stage pulse-tube 12 and the low-temperature end (lower end) of the first-stage regenerator tube 14 are connected to each other through the gas passage. The first-stage cooling stage 15 is thermally and mechanically connected to an object to be cooled (not shown in the figure) so that cold and warm is picked up by the object to be cooled.

The second-stage regenerator tube 16 includes a hollow cylinder made of, for example, a stainless steel and a regenerator material accommodated in the cylinder. The regenerator material is preferably a wire netting of copper or a stainless steel. The second-stage pulse-tube 13 is preferably a hollow cylinder made of, for example, a stainless steel. The second-stage cooling stage 17 has a gas passage formed therein so that the low-temperature end (lower end) of the second-stage pulse-tube 13 and the low-temperature end (lower end) of the second-stage regenerator tube 16 are connected to each other through the gas passage. The second-stage cooling stage 17 is thermally and mechanically connected to an object to be cooled (not shown in the figure) so that cold and warm is picked up by the object to be cooled.

Here, as shown in FIG. 2, the pulse-tube refrigerating machine 100 according to the present embodiment is configured and arranged so that a portion (high-temperature end) of the second-stage pulse-tube 13 is formed within the housing 5. That is, a space or cavity 26 having a diameter substantially equal to the inner diameter of the second-stage pulse-tube 13 is formed in the housing 5 so that the space 26 serves as the upper end (high-temperature end) of the second-stage pulse-tube 13 when the cylinder part 2 is connected to the housing part 1 through the flange 11. By providing the space 26 in the housing 5, the length of the cylinder part 2 can be reduced without reducing the overall length of the second-stage pulse-tube 13, which results in a compact pulse-tube refrigerating machine.

It should be noted that although a portion of the second-stage pulse-tube 13 is formed in the housing 5 in the example shown in FIG. 2, a portion of the first-stage pulse-tube 12 may also be formed in the housing 5 similar to the second-stage pulse-tube 13.

A description will now be given of an operation of the pulse-tube refrigerating machine 100. First, when the intake valve 24A is opened and the exhaust valve is closed, a high-pressure refrigerant gas (for example, helium gas) flows from the compressor 3 into the first-stage regenerator tube 14. The refrigerant gas is cooled by the regenerator material in the first-stage regenerator tube 14. Thus, the refrigerant gas flows through the first-stage regenerator tube 14 while the temperature thereof is decreased, and flows into the gas passage formed in the first-stage cooling stage 15 from the low-temperature end of the first-stage regenerator tube 14. Then, the refrigerant gas flows into the first-stage pulse-tube 12. The low-pressure refrigerant gas already stored in the first-stage pulse-tube 12 is compressed by the high-pressure refrigerant gas supplied from the first-stage cooling stage 15. Thus, the pressure inside the first-stage pulse-tube 12 becomes higher than the pressure inside the first-stage reservoir 22, and the refrigerant gas flows through the orifices 25 and the gas passage 21 into the first-stage reservoir 22.

Moreover, a part of the high-pressure refrigerant gas cooled by the first-stage regenerator tube 14 flows into the second-stage regenerator tube 16. The refrigerant gas is cooled by the regenerator material in the second-stage regenerator tube 16. Thus, the refrigerant gas flows through the second-stage regenerator tube 16 while the temperature thereof is decreased, and flows into the gas passage formed in the second-stage cooling stage 17 from the low-temperature end of the second-stage regenerator tube 16. Then, the refrigerant gas flows into the second-stage pulse-tube 13. Then the refrigerant gas passes through the orifices 25 and the gas passage 21 and flows into the second-stage reservoir 23.

Then, the intake valve 24A is closed and the exhaust valve 24B is opened, and the refrigerant gas in the first-stage pulse-tube 12 and the second-stage pulse-tube 13 returns to the compressor 3 through the high-temperature end of the first-stage regenerator tube 14 and the exhaust valve 24B. Since the first-stage pulse-tube 12 and the first-stage reservoir 22 are connected to each other through the orifices 25 and also the second-stage pulse-tube 13 and the second-stage reservoir 23 are connected to each other through the orifices 25, the phase of the pressure fluctuation of the refrigerant gas and the phase of the volumetric change of the refrigerant gas vary with a fixed phase difference. Due to the phase difference, cooling is generated by the adiabatic expansion of the refrigerant gas at the low-temperature end of the first-stage pulse-tube 12 and the low-temperature end of the second-stage pulse-tube 13. The pulse-tube refrigerating machine 100 functions as a refrigerating machine by repeating the above-mentioned operation.

In the pulse-tube refrigerating machine 100 according to the present embodiment, a heat-shielding material is provided to at least a portion of the space or cavity 26, which forms the high-temperature end of the second-stage pulse-tube 13. It should be noted that the heat-shielding material is not shown in FIG. 2 for the sake of clarification of the drawing.

Figure 3:
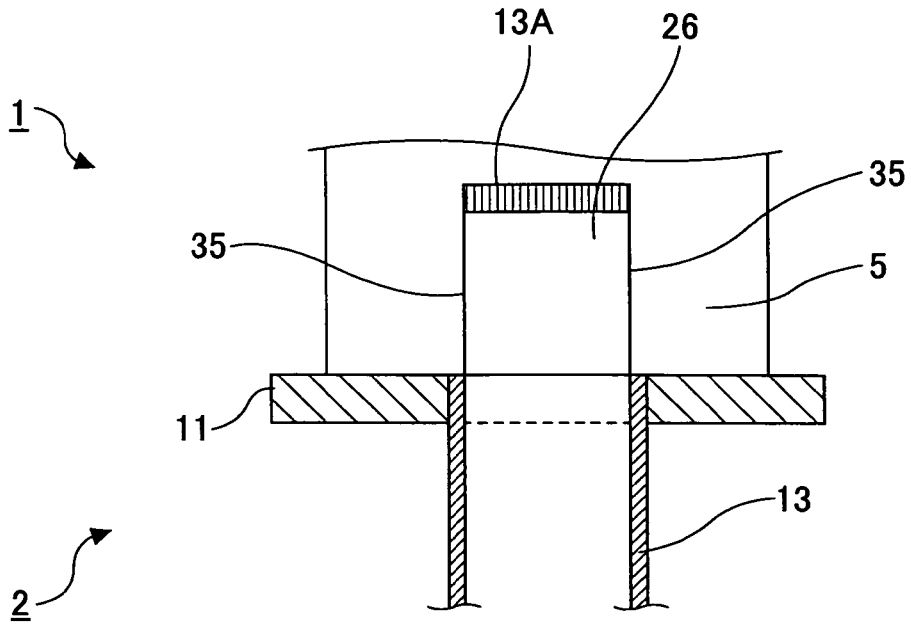
FIG. 3 is an enlarged cross-sectional view of a high-temperature end of a second-stage pulse-tube shown in FIG. 1.
Figure 4:
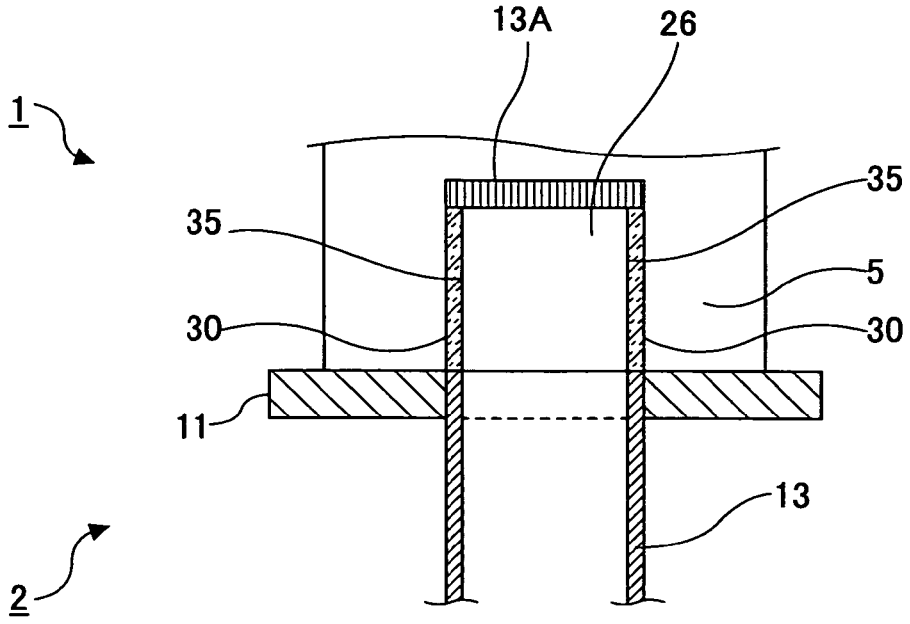
FIG. 4 is an enlarged cross-sectional view of a high-temperature end of a second-stage pulse-tube shown in FIG. 2.

A description will be given below of the heat-shielding material. FIG. 3 is an enlarged cross-sectional view of the upper end (high-temperature end) of the second-stage pulse-tube of the pulse-tube refrigerating machine shown in FIG. 1. FIG. 4 is an enlarged cross-sectional view of the upper end (high-temperature end) of the second-stage pulse-tube of the pulse-tube refrigerating machine 100 according to the present embodiment shown in FIG. 4.

As shown in FIG. 3, in the two-stage pulse-tube refrigerating machine having the space 26 in the housing 5, the space 26 is defined by a housing wall 35. Accordingly, the refrigerant gas flowing through the second-stage pulse-tube 13 is directly brought into contact with the housing wall 35 defining the space 26. Here, the housing 5 is at a room temperature, while the refrigerant gas is at a relatively low-temperature. Thus, a heat transfer tends to occur through the housing wall 35 in the space 26, and such a heat transfer may generate a heat loss of the refrigerant gas. Such a heat loss of the refrigerant gas causes a decrease, in the refrigerating capacity of the pulse-tube refrigerating machine.

Additionally, according to the contacting state of the refrigerant gas with the housing wall 35, the characteristic of the refrigerant gas is more sensitive to a change in the ambient environmental condition on the housing side. For example, the characteristic of the refrigerant is influenced greatly by a slight change in the ambient environmental condition such as an ambient temperature. This means that if the settings for operating the pulse-tube refrigerating machine, such as, for example, a setting of open and close timing of the orifice, is optimized based on a certain state of the refrigerant gas as a reference, an actual operation of the pulse-tube refrigerating machine is deviated from an optimum state due to a slight change in an ambient environmental condition. Therefore, in such a case, there is a problem in that a finally-obtained refrigerating capacity of the pulse-tube refrigerating machine is reduced.

On the other hand, the pulse-tube refrigerating machine 100 according to the present embodiment is provided with the heat-shielding material 30 on the housing wall 35 (inner surface) defining the space or cavity 26. The heat-shielding material 30 is formed of a material having a low thermal conductivity. When the heat-shielding material 30 is provided, the refrigerant gas flowing through the space 26 via the second-stage pulse-pipe 13 is brought into contact with the heat-shielding material 30 in the space 26. In such a case, the refrigerant gas is prevented from being brought into contact with the housing wall 35 of the housing 5, which is made of a metal having a high thermal conductivity such as aluminum or an aluminum alloy, which effectively suppresses a heat loss of the refrigerant gas. Accordingly, the reduction of the refrigerating capacity of the pulse-tube refrigerating machine due to the heat loss generated by the contact of the refrigerant gas with the housing wall can be avoided.

It should be noted that the heat-shielding material 30 is provided to cover the entire housing wall 35 in the example shown in FIG. 4. However, it is obvious for a person skilled in the art that the heat-shielding material 30 may be provided to at least a portion of the housing wall 35 so as to obtain the same effect in varying degrees.

Here, it is preferable that the heat-shielding material 30 is made of a material having a thermal conductivity lower than that of a stainless steel. For example, the heat-shielding material 30 is preferably made of an organic polymer material such as a plastic or a ceramic material such as a glass. More preferably, the heat-shielding material 30 is made of polytetrafluoroethylene, a glass fiber reinforced plastic (GFRP), a silicon carbide base fiber reinforced plastic (SiC-FRP), or a foam material such as a polyethylene foam, a polystyrene foam, or a polypropylene foam (EPP).

Figure 5:
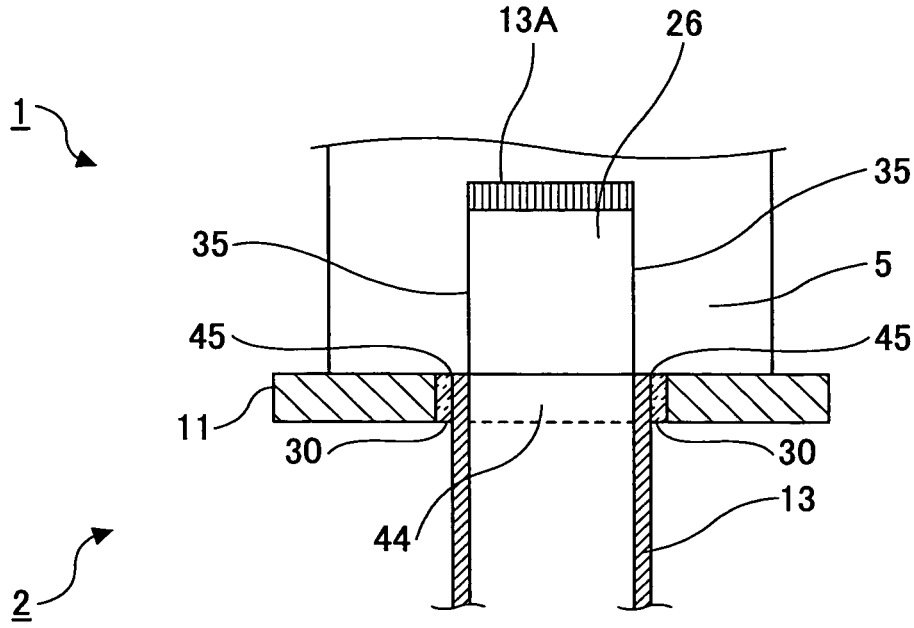
FIG. 5 is an enlarged cross-sectional view of a variation of the high-temperature end of the second-stage pulse-tube shown in FIG. 2.

A description will now be given, with reference to FIG. 5, of a variation of the heat-shielding material 30. FIG. 5 is an enlarged cross-sectional view of the high-temperature end of the second-stage pulse-tube 13 provided with the variation of the heat-shielding material 30.

In the variation shown in FIG. 5, the heat-shielding material 30 is provided not to the housing wall 35 but to an inner wall 45 of a through opening 44 of the flange 11. That is, the outer surface of the second-stage pulse-tube 13 inserted into the through opening 44 of the flange 11 is brought into contact with the heat-shielding material 30.

If the heat-shielding material 30 is not provided, the outer surface of the second-stage pulse-tube 13 is in contact with the flange wall 45 defining the through opening 44 in the flange 11. Since the flange is normally made of a stainless steel such as SUS304 specified by JIS (Japanese Industrial Standards). Accordingly, there may occur the same heat loss problem of the refrigerant gas in the contact portion of the second-stage pulse-tube 13 with the flange 11. Particularly, if the thickness of the flange 11 is large, a heat loss due to a heat transfer through the contact portion between the flange 11 and the second-stage pulse-tube 13 (more specifically, the outer surface of the cylinder constituting the second-stage pulse-tube 13) cannot be negligible.

However, in the variation shown in FIG. 5, since the outer surface of the second-stage pulse-tube 13 is in contact with the heat-shielding material 30 having a low thermal conductivity, a heat loss of the refrigerant gas in the position where the second-stage pulse-tube contacts with the flange 11 is suppressed.

The present variation is preferably applied particularly to the pulse-tube refrigerating machine having a flange of a large thickness. Additionally, the present variation can be applied to the pulse-tube refrigerating machine such as shown in FIG. 1, which does not have the space 26 constituting a portion of the second-stage pulse-tube 13 in the housing 5. Further, also in the present variation, there is no need to provide the heat-shielding material 30 over the entire flange wall 45 (entire inner surface) of the through opening 44 of the flange 11 and the heat-shielding material may be provided to at least a portion of the flange wall 45.

Figure 6:
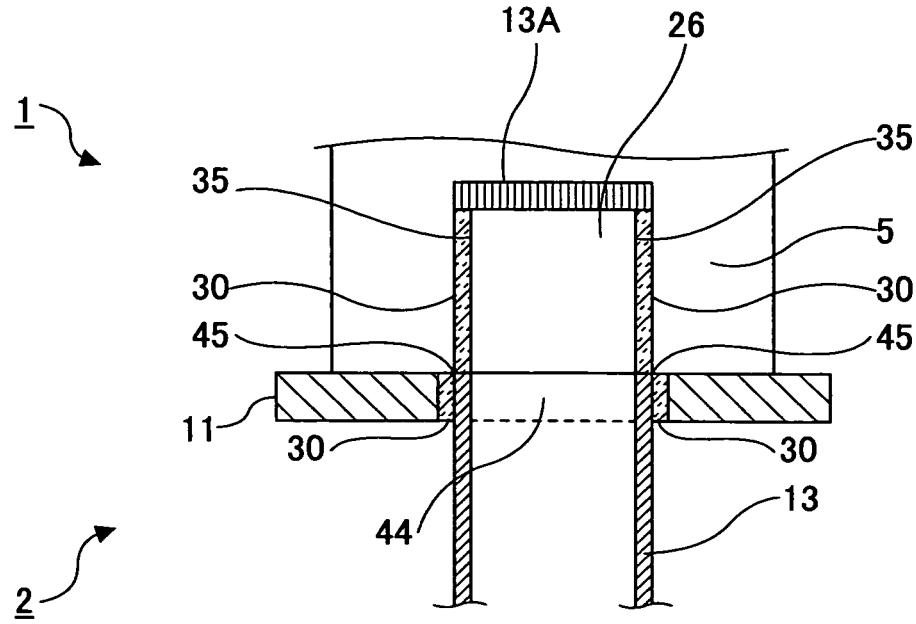
FIG. 6 is an enlarged cross-sectional view of another variation of the high-temperature end of the second-stage pulse-tube shown in FIG. 2.

FIG. 6 shows another variation. The variation shown in FIG. 6 is a combination of the structure shown in FIG. 4 and the structure shown in FIG. 5. That is, in the variation shown in FIG. 6, the heat-shielding material 30 having a low thermal conductivity is provided to both the housing wall 35 defining the space 26 in the housing 5 and the flange wall 45 defining the through opening 44 of the flange 11. In the present variation, since a heat loss of the refrigerant gas through the housing wall 35 and the flange wall 45 can be suppressed, the refrigerating characteristic of the pulse-tube refrigerating machine can be maintained in a further improved state.

Figure 7:
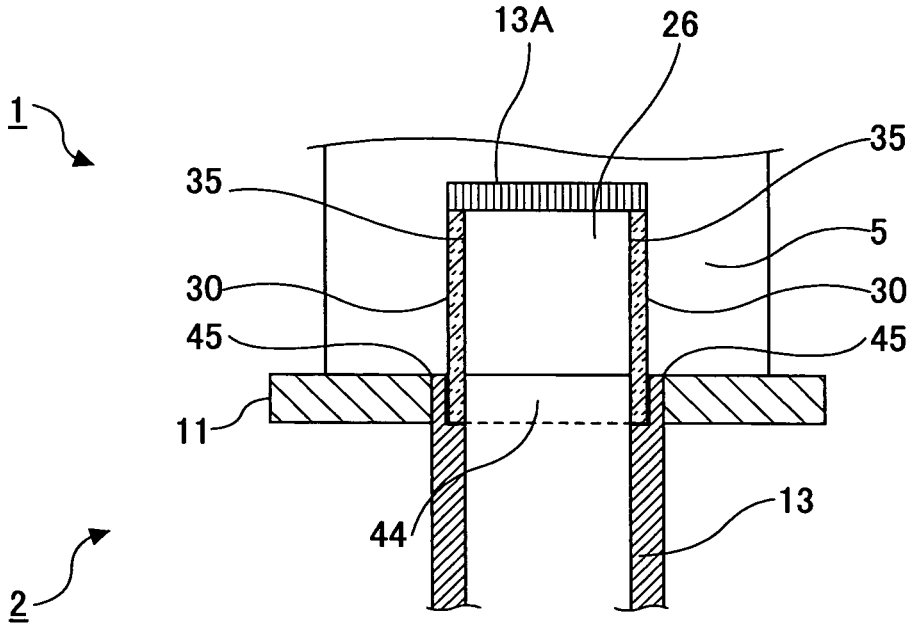
FIG. 7 is an enlarged cross-sectional view of a further variation of the high-temperature end of the second-stage pulse-tube shown in FIG. 2.

FIG. 7 shows a further variation. In the variation shown in FIG. 7, a step is formed on a portion of the inner surface of the second-stage pulse-tube 13 inserted into the through opening 44 of the flange 11. An end of the heat-shielding material 30 is inserted into the stepped portion. According to this structure, the heat-shielding material 30 can be easily joined to the second-stage pulse-tube 13.

It should be noted that the above-mentioned embodiment and variations are directed to the structure in which the housing wall 35 defining the space 26 in the housing 5 is used as a portion of the passage (the second-stage pulse-tube 13) of the refrigerant gas, however, the present invention is not limited to such a structure. For example, in the structure shown in FIG. 4, the second-stage pulse-tube 13 may be inserted into the space 26 formed in the housing 5. In such a case, the housing wall 35 is brought into contact with a portion of the hollow cylinder constituting the second-stage pulse-tube 13 that extends from the second-stage cooling stage 17 to the space 26, but, even in such a case, the above-mentioned effect can be obtained by providing the heat-shielding material 30 to a portion of the housing wall 35, which contacts with the second-stage pulse-tube 13.

On the other hand, in the structure shown in FIG. 5 and FIG. 6, the second-stage pulse-tube 13 is inserted into the through opening 44 of the flange 11 and the flange wall 45 is in contact with the outer surface of the second-stage pulse-tube 13. However, the flange wall 45 defining the through opening 44 of the flange 11 may be used as a portion of the passage (the second-stage pulse-tube 13) of the refrigerant gas. Also in such a case, the above-mentioned effect can be obtained by providing the heat-shielding material 30 to the flange wall 45 defining the through opening 44.

It should be noted that although the two-stage pulse-tube refrigerating machine has been explained specifically in the above-mentioned embodiment, the present invention is not limited to the two-stage pulse-tube refrigerating machine. It is obvious for a person skilled in the art that the present invention is applicable to a single-stage pulse-tube refrigerating machine and multi-stage pulse-tube refrigerating machine of three or more stages.

As mentioned above, the pulse-tube refrigerating machine according to the above-mentioned embodiment and variations is provided with a heat-shielding material on at least one of a wall defining a portion of a pulse-tube and a wall contacting with a portion of the pulse-tube. Thus, a heat loss due to a heat transfer between the refrigerant gas flowing through the pulse-tube and the external environment hardly occurs, thereby providing a pulse-tube refrigerating machine having an improved refrigerating capacity.

Additionally, in a case where a space for accommodating a high-temperature end of the pulse-tube is provided in the housing, the overall length of the cylinder and further the overall length of the pulse-tube refrigerating machine can be reduced, and a handling operation such as attaching the pulse-tube refrigerating machine to an object to be cooled becomes easy.

It should be noted that although the explanation has been made with the double inlet type pulse-tube refrigerating machine as an example in the above description, the present invention is applicable to other pulse-tube refrigerating machines of other types such as an orifice type or a four valve type.

In order to confirm the effect of the above-mentioned embodiment and variations, two types of two-stage pulse-tube refrigerating machines are fabricated, and the refrigerating capacities thereof were evaluated. Each of the fabricated two two-stage pulse-tube refrigerating machines was a type having a space serving as a high-temperature end of a second-stage pulse-tube in a housing. However, the hollow cylinder constituting the second-stage pulse-tube was not inserted into the space. The inner diameter of the space formed in the housing was substantially equal to the inner diameter of the second-stage pulse-tube, and the depth of the space was 8% of the overall length of the second-stage pulse-tube (excluding the space formed in the housing). Additionally, in each of the two-stage pulse-tube refrigerating machines, the second-stage pulse-tube was inserted into a through opening of a flange so that an end of a hollow cylinder constituting the second-stage pulse-tube does not protrude from the surface of the flange (more specifically, an end of the hollow cylinder is substantially aligned with the height level of the top surface of the flange.

The first pulse-tube refrigerating machine, as an example of the embodiment of the present invention, included the second-stage pulse-tube having the high-temperature end structure shown in FIG. 4. That is, the inner surface of the space formed in the housing of the first example of the pulse-tube refrigerating machine was provided with a heat-shielding material, which was made of polytetrafluoroethylene (Teflon (trademark of Dupont Co.)) and had a thickness of 1.5 mm. It should be noted that no heat-shielding material was provided to the flange wall, which the second-stage pulse-tube inserted into the flange is brought into contact with.

Comparison of the refrigerating capacities of the two pulse-tube refrigerating machines was made. The first pulse-tube refrigerating machine according to the embodiment exhibited a refrigerating capacity of 4.1K at a load of 1 W and an input power supply frequency of 50 Hz. When the input power supply frequency was changed into 60 Hz, the refrigerating capacity was 4.1 K and there was no change in the refrigerating capacity due to the change in the input power supply frequency.

On the other hand, the second pulse-tube refrigerating machine as a comparison example exhibited a refrigerating capacity of 4.1 K at a load of 1 W and an input power supply frequency of 50 Hz, but the refrigerating capacity was changed to 4.6 K at a load of 1 W when the input power supply frequency was changed into 60 Hz. This change corresponds to a reduction in the refrigerating capacity by about 30%. It was considered that the reason for the reduction in the refrigerating capacity is that the characteristic of the refrigerating gas flowing through the pulse-tube (especially, a phase relationship between a pressure and a volume) was changed and the timings of opening and closing the orifices were deviated from appropriate timings.

As mentioned above, it was confirmed that, in the pulse-tube refrigerating machine according to the embodiment of the present invention, if the operating condition is changed, an influence given to the characteristic of the refrigerant gas by the change is small and the characteristics such as a refrigerating capacity can be maintained at a preferable state.

The present invention is applicable to a single-stage or multi-stage pulse-tube refrigerating machine used in a low-temperature system such as, for example, a nuclear magnetic resonance diagnosis apparatus, a superconductive magnet apparatus, a cryopump, or the like.

The present invention is not limited to the specifically disclosed embodiments, and variations and modifications may be made without departing from the scope of the present invention.

The present application is based on Japanese priority application No. 2007-117552 filed Apr. 26, 2007, the entire contents of which are hereby incorporated herein by reference.

What is claimed is:

1. A pulse-tube refrigerating machine comprising:

a compressor that pressurizes a refrigerant gas;

a regenerator tube accommodating a regenerator material therein;

a pulse-tube of a hollow cylinder through which the refrigerant gas flows, the pulse tube having an pulse-tube end portion and terminating in a pulse-tube end;

an intake valve and an exhaust valve provided between said compressor and said regenerator tube;

a housing having an inner space formed therein, the inner space defined by an inner wall surface;

a flange having a flat first surface and an opposite flat second surface disposed opposite of the flat first surface and extending parallel thereto, the flange having an opening formed therethrough and connected to the housing and the pulse tube with the pulse-tube end portion extending into and through the opening from the flat first surface and with the pulse-tube end disposed in a common plane with the flat second surface in a manner that the pulse tube and the inner space are in fluid communication with each other; and a heat shield fabricated from a heat shielding material, the heat shield being in contact with the inner wall surface of the housing and the end portion of the pulse tube.

2. The pulse-tube refrigerating machine as claimed in claim 1, wherein the end portion of the pulse-tube is configured in a stepped-down configuration to form an inner stepped-down groove sized to receive a portion of the heat shield projecting outwardly from the inner space.

3. The pulse-tube refrigerating machine as claimed in claim 1, further comprising a heat shield ring fabricated from the heat shielding material, the heat shield ring disposed in the opening and between and in contact with the flange and the end portion of the pulse-tube, the heat shield ring extending to and between the flat first and second surfaces of the flange.

4. A pulse-tube refrigerating machine comprising:

a compressor that pressurizes a refrigerant gas;

a regenerator tube accommodating a regenerator material therein;

a pulse-tube of a hollow cylinder through which the refrigerant gas flows, the pulse tube having an pulse-tube end portion and terminating in a pulse-tube end;

an intake valve and an exhaust valve provided between said compressor and said regenerator tube;

a housing having an inner space formed therein, the inner space defined by an inner wall surface;

a flange having a flat first surface and an opposite flat second surface disposed opposite of the flat first surface and extending parallel thereto, the flange having an opening formed therethrough and connected to the housing with the pulse-tube end portion extending into and through the opening from the flat first surface and with the pulse-tube end disposed in a common plane with the flat second surface so that the pulse tube and the inner space are in fluid communication with each other; and a heat shield ring fabricated from a heat shielding material, the heat shield ring disposed in the opening and between and in contact with the flange and the end portion of the pulse-tube, the heat shield ring extending to and between the flat first and second surfaces of the flange.

* * * * *